US010465151B2

(12) United States Patent
Mausberg

(10) Patent No.: US 10,465,151 B2
(45) Date of Patent: Nov. 5, 2019

(54) THREE-PHASE HEAVY-DUTY LAUNDRY DETERGENT WIPE AND METHOD FOR MANUFACTURING SAME

(71) Applicant: COIN Consulting GmbH, Menden (DE)

(72) Inventor: Marcus Mausberg, Menden (DE)

(73) Assignee: COIN Consulting GmbH, Menden (DE)

( * ) Notice: Subject to any disclaimer, the term of this patent is extended or adjusted under 35 U.S.C. 154(b) by 414 days.

(21) Appl. No.: 14/913,886

(22) PCT Filed: May 19, 2014

(86) PCT No.: PCT/DE2014/000253
§ 371 (c)(1),
(2) Date: Feb. 23, 2016

(87) PCT Pub. No.: WO2015/027970
PCT Pub. Date: Mar. 5, 2015

(65) Prior Publication Data

US 2016/0208204 A1 Jul. 21, 2016

(30) Foreign Application Priority Data

Aug. 26, 2013 (DE) ..... 10 2013 014 015
Apr. 7, 2014 (DE) ..... 10 2014 004 915

(51) Int. Cl.
*C11D 17/04* (2006.01)
*C11D 3/12* (2006.01)

(52) U.S. Cl.
CPC ..... *C11D 17/049* (2013.01); *C11D 3/128* (2013.01)

(58) Field of Classification Search
CPC ..... C11D 17/049; C11D 3/128
See application file for complete search history.

(56) References Cited

U.S. PATENT DOCUMENTS 4,170,565 A * 10/1979 Flesher ..... C11D 17/046 428/195.1
5,863,887 A 1/1999 Gillette
(Continued)

FOREIGN PATENT DOCUMENTS

AT 405 786 11/1999
CN 1239996 A 12/1999
(Continued)

OTHER PUBLICATIONS

International Search Report issued in corresponding PCT International Application No. PCT/DE2014/000253.
(Continued)

*Primary Examiner* — Nicole M. Buie-Hatcher
*Assistant Examiner* — M. Reza Asdjodi
(74) *Attorney, Agent, or Firm* — Marilyn M. Brogan; Haug Partners LLP

(57) ABSTRACT

The present invention discloses a three-phase heavy-duty laundry detergent wipe, comprising a substrate 1 which is solid at ambient temperature as a third phase and a dispersion applied to the substrate and consisting of a liquid washing detergent 5 as a first phase and a water insoluble functional additive 2 as a second phase; and a method for manufacturing same. In particular, the second phase, i.e., the additive 2, of the dispersion can be a zeolite. The substrate 1 can consist of fatty alcohols, viscose, polyethylene, polypropylene or polyester. Furthermore, the present invention discloses a homogeneous three-phase laundry detergent wipe and a method for manufacturing same, wherein the substrate is moistened with the dispersion via direct contact with a first moistening rod 3 which rests on one side of the substrate to be moistened and a second counter moistening rod 4 which rests on the opposing side of the substrate to be moistened such that the washing active substances and solid
(Continued)

Figure 1:
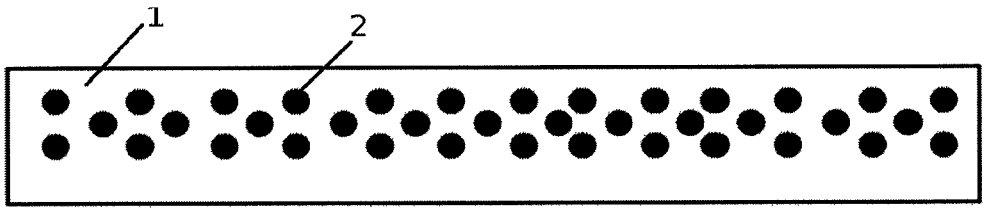
Fig. 1 (Prior Art)

components of the dispersion 2, resp., are distributed homogeneously across the substrate after moistening.

10 Claims, 1 Drawing Sheet

(56) References Cited

U.S. PATENT DOCUMENTS

| | | | | |
|---|---|---|---|---|
| 6,130,193 | A | 10/2000 | Gillette | |
| 6,750,160 | B1 * | 6/2004 | Hanaoka | C11D 3/14 15/104.93 |
| 9,803,307 | B2 * | 10/2017 | Jenkins | D06F 35/006 |
| 2003/0207630 | A1 * | 11/2003 | Graham | C11D 3/0073 442/118 |
| 2005/0153857 | A1 * | 7/2005 | Sherry | A47L 13/20 510/295 |
| 2013/0283542 | A1 * | 10/2013 | Jenkins | C11D 3/1206 8/137 |

FOREIGN PATENT DOCUMENTS

| | | | | |
|---|---|---|---|---|
| CN | 1177025 | C | 11/2004 | |
| DE | 10 2010 060 126 | | 4/2012 | |
| EP | 0 186 208 | | 7/1986 | |
| EP | 0 186 208 | A2 | 7/1986 | |
| EP | 0186208 | A2 * | 7/1986 | A47L 13/17 |
| EP | 0 957 158 | | 11/1999 | |
| EP | 0 957 158 | A1 | 11/1999 | |
| EP | 0957158 | A1 * | 11/1999 | C11D 1/62 |
| WO | WO 84/03459 | | 9/1984 | |
| WO | WO 84/03459 | A1 | 9/1984 | |
| WO | WO 8403459 | A1 * | 9/1984 | C11D 3/1246 |

OTHER PUBLICATIONS

Search Report issued in the corresponding Chinese application No. 201480056759.X.

Search Report issued in the corresponding German application No. 10 2013 014 015.3.

Search Report issued in the corresponding Russian application.

* cited by examiner

THREE-PHASE HEAVY-DUTY LAUNDRY DETERGENT WIPE AND METHOD FOR MANUFACTURING SAME

FIELD OF THE INVENTION

The present invention is directed to a three-phase heavy-duty laundry detergent wipe for cleaning textiles and to a method for manufacturing same and, in particular, to a three-phase heavy-duty laundry detergent wipe with a homogeneous distribution of the washing active substances and a method for producing same.

BACKGROUND OF THE INVENTION AND PRIOR ART

The pursuit of hygiene exists from the beginning of mankind. Hygiene eventually is an important aspect of everyday life. The hygienic approach primarily consists in maintaining the health. In addition to the general cleaning effects scent and improved cleaning power of the raw material compositions have also come under scrutiny due to extended possibilities. Cleaning power optimization is particularly characterized by the ability to extend a hygienically clean state and an improvement of the degree of cleaning.

Nowadays hygiene can be divided into the fields of body, surface and textile hygiene. The latter is divided into applications depending on textile material and color. At least since the Nineties of the $20^{th}$ century the consumer's awareness has been raised of ecological cleaning. In this regard, it is desirable to maintain the advantages of conventional washing detergents, on the one hand, and to find further innovative and ecologically feasible product solutions, on the other hand.

With the beginning of industrial production, laundry detergents have been realized as powders. This very day, a powder laundry detergent consists of a mixture of different washing active substances.

With the progress during the development of laundry detergents enzymes and other new surfactant compositions entered this market segment. In addition to the substances necessary for cleaning large amounts of filler material are added nowadays. Accordingly, no change of the consumer's dosing behavior was necessary. First attempts to omit filler material resulted in an overdosing of the surfactants due to the application the users were used to.

Then liquid washing detergents were introduced which could be dosed residue-free and, thus, offered a physical alternative to the mixture of solids of laundry detergents. However, up to now liquid washing detergents do not accomplish the cleaning level of a heavy-duty laundry detergent (i.e., a mixture of solids). This is due to the fact that a liquid washing detergent is limited to liquid components or components which are well soluble in water. The essential substances missing in a liquid washing detergent are the zeolites. The latter support dirt adsorption and brightening/color fastness during the application.

A current product trend is the simplified way of portioning the washing detergent. This can be achieved, on the one hand, by packing a liquid washing detergent in small polymer pouches up to multi chamber systems. However, the problem of the missing zeolite mentioned above still persists. Another physical modification of the washing detergent consists in mixing a washing detergent with a fatty alcohol in order to achieve desired forms. Both product concepts, however, describe a one-phase product which can only be differentiated by way of its portioning.

As disclosed in DE 10 2010 060 126 A1, a multi-phase product can be provided. The laundry detergent wipe disclosed therein is characterized by combining a carrier material with an impregnating liquid (two-phase product). However, in this case the disadvantage of the missing zeolite still persists.

Accordingly, it is the object of the present invention to provide a laundry detergent wipe as an alternative to a mixture of solids which permits the contribution of additives such as zeolites in order to obtain all features of a heavy-duty laundry detergent.

In order to obtain an optimal application of the inventive product it is advantageous, as regards the dispersion and the active substances contained therein, to achieve a homogeneous distribution of the dispersion across the substrate.

In the prior art the following methods for manufacturing wet wipes have been used:

1. Impregnation by means of a moistening rod, wherein the moistening is achieved by direct contact with the moistening rod.
2. Impregnation by means of a moistening rod, wherein the substrate is moistened by spraying.
3. Impregnation by means of a moistening trough, wherein the substrate is moistened by immersion.

However, these methods would not result in a homogeneous distribution of the washing active substances and the solid components, resp., on the substrate as can be obtained from FIG. 1.

Accordingly, it is a further object of the present invention to provide a laundry detergent wipe with a homogeneous distribution of the washing active substances and the solid components, resp., across the substrate and a method for manufacturing same in order to achieve an improved distribution of the active substances and, thus, an improved cleaning power of the laundry detergent wipe.

SUMMARY OF THE INVENTION

It is an object of the present invention to provide a three-phase heavy-duty laundry detergent wipe which overcomes the disadvantages of mere liquid washing detergents by containing additives such as, for example, zeolites.

This object has been achieved by a method for manufacturing a three-phase heavy-duty laundry detergent wipe according to claim 1, wherein the method is characterized in that a dispersion consisting of a liquid washing detergent and a water insoluble additive is applied to a substrate which is solid at ambient temperature.

The three-phase heavy-duty laundry detergent wipe manufactured in this way is disclosed, which requires a substrate which is solid at ambient temperature and to which a dispersion consisting of a liquid washing detergent and a water insoluble additive is applied.

Advantageous embodiments of the wet detergent wipe are disclosed.

It is a further object of the present invention to provide a three-phase laundry detergent wipe—and a method for manufacturing same—with a more uniform, in particular homogeneous, distribution of the washing active substances and the solid components, resp., of the dispersion across the carrier substrate.

This object has been achieved by a method for manufacturing a homogeneous three-phase laundry detergent wipe, wherein a dispersion is applied to a substrate which is solid at ambient temperature, characterized in that the substrate is moistened with the dispersion via direct contact with a first moistening rod which rests on one side of the substrate to be moistened and a second counter moistening rod which rests on the opposing side of the substrate to be moistened such that the washing active substances and solid components, resp., of the dispersion are distributed homogeneously across the substrate.

The three-phase heavy-duty laundry detergent wipe manufactured in this way is disclosed which requires a substrate which is solid at ambient temperature and to which a dispersion has been applied and which is characterized in that the washing active substances and solid components, resp., of the dispersion are distributed homogeneously across the substrate.

Advantageous embodiments of the manufacturing method and the wet detergent wipe are disclosed.

DESCRIPTION OF THE PREFERRED EMBODIMENTS

Surprisingly, the inventive laundry product could be realized by incorporating additives such as zeolites into an impregnating solution in the form of a dispersion. A fine grain size and increasing the viscosity (>500 mPas) made a considerable reduction of sedimentation possible. While a dispersion is not possible in the field of liquid washing detergents, it has a decisive function for the inventive heavy-duty laundry detergent wipe.

Due to the sedimentation effects, dispersions are currently not a physical form of laundry detergents because the objective of the latter is a continuous, i.e., statistically uniform and homogeneous, resp., product which provides a constant product performance.

The present invention makes the use of dispersions in a laundry detergent product possible for the first time. According the present invention, the continuous state desired for laundry detergent products has been achieved by applying a dispersion to a carrier material. The carrier material can be a non-woven, a fatty alcohol or a substrate for a phase combination of a dispersion with another separate phase.

In total, the present invention consists of three phases. The first phase 5 of the dispersion is a liquid washing detergent concentrate consisting of washing active substances, enzymes, and, where appropriate, bleaching agents; the second phase 2 of the dispersion is a brightener/builder and a supportive substance for supporting dirt adsorption, resp., (for example, zeolite) in solid modification; the third phase 1 is a substrate in solid modification at ambient temperature onto which the mixture of 5 and 2 is applied, wherein the substrate can consist of fatty alcohols, viscose, polyethylene, polypropylene or polyester.

The solid phase of the dispersion, i.e., the second phase 2, is a functional component of the inventive heavy-duty laundry detergent wipe. The first phase of the dispersion, i.e., the liquid washing detergent 5, can have a viscosity greater than 500 mPas. The substrate 1 serves the purpose to statistically fix the dispersion and consists of a raw material which is solid at ambient temperature. Finally, all known components of a heavy-duty laundry detergent can be included.

TABLE 1

| | heavy-duty | color | fine | sports |
|---|---|---|---|---|
| anionic surfactants (SAS, LAS, LAES) | x | x | x | x |
| non-ionic surfactants (FAE, APG, cocamides) | x e.g. Safol 23E7 | x e.g. Lutensol AO 7 | x | x |
| amphoteric surfactants (aminoxides, betaines, sultaines) | | | | |
| soap (C10-18 fatty acid salts) | x | x | x | x |
| phosphonates/complexing agents (EDTMP, DTPMP, HEDP, ATMP, MGDA, GLDA, TNC) | x e.g. Cublen E 3115 | x | x | x e.g. Cublen D 3217 N |
| optical brighteners | x e.g. Tinopal CBS, Megaluxx B | | | |
| enzymes (protease, amylase, lipase, mannanase, cellulase, pectate lyase) | x | x | x | x |
| builders (polycarboxylates, zeolites) | x e.g. Doucil A 24 | x | x | x |
| colorants | | x | x | x |
| fragrances | x | x | x | x |
| stabilizers (propylene glycol, borax, glycerin, inulin) | x | x | x | x e.g. Inutec PFX |
| preservatives | x e.g. Parmetol MBX | x | x | x e.g. Acticide MBS 5050 |
| defoamers | | | x e.g. Hansa Care 5710 | |
| color protection | | x e.g. BGB PC0613 | x e.g. Sokalan HP 66K | x e.g. Polyquart FDI |
| soil-release polymer | x e.g. Repel-O-Tex | x | | x e.g. Texcare SRN-170 |
| hydrotrope agents (sodium cunmol sulfonate) | | x | x | |
| odor adsorbers | | | | x e.g. Flexisorb |
| clouding agents | | | | x e.g. Euperlan HCO |
| pH regulating agents (citric acid, sodium hydroxide) | x | x | x | x |
| conditioners | | | | |

TABLE 1-continued

| | | | | |
|---|---|---|---|---|
| auxiliary materials (starch, thickeners, silicates) | x | x | x | x |

| black | white | wool | jeans | curtains |
|---|---|---|---|---|
| x e.g. Hostapur SAS 60 | x | x | x | |
| x | x | x | x | x |
| | | x e.g. cocamide propyl betain | | |
| x | x | x | x | |
| x | | x | x | |
| | x | | | x |
| x | x | | x | |
| x | x | x | x | |
| x | | x | x | |
| x | x | x | x | |
| x | x | | x | |
| x | x | x | x | x |
| | | | | x |
| x | x | x | x | |
| | x | | | x |
| x | x | x | x | |
| x | x | x | x | x |
| | | x e.g. hydrolized ceratine | | |
| x | x | x | x | x e.g. Emcol HE |

The multiple mixing of the phases to a three-phase heavy-duty laundry detergent wipe makes the incorporation of a water insoluble brightener/builder and dirt adsorber, resp., into a liquid washing detergent and the necessary statistically stable uniform distribution via application on a substrate possible for the first time.

Figure 2:
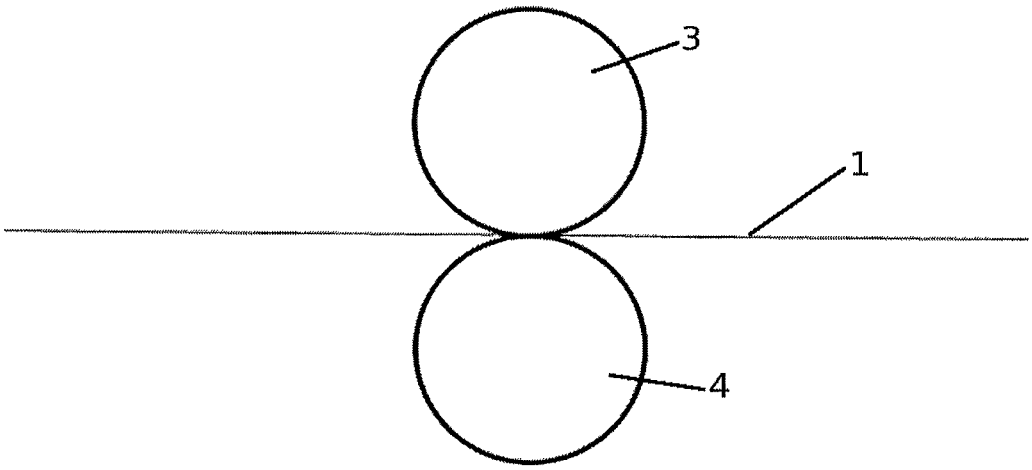
Figure 3:
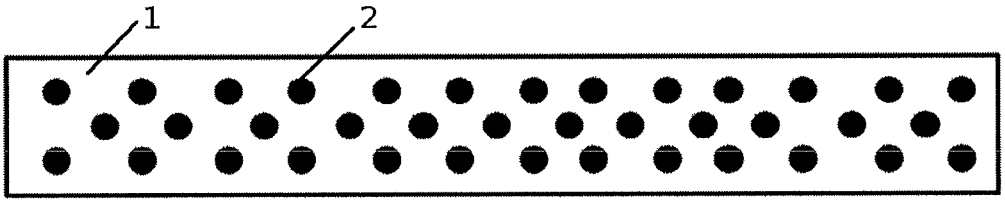

FIG. 1 shows the result of moistening a substrate and a carrier material, resp., across a section of the substrate 1 by means of a moistening rod according to the prior art. As can be seen, the distribution of the washing active substances and solid components 2, resp., of the dispersion is not homogeneous. Surprisingly, the inventive laundry detergent wipe with a homogeneous distribution of the washing active substances and the solid components, resp., of the dispersion could be realized by installing two moistening rods in contrast to prior art methods, i.e., a first moistening rod 3 and a second counter moistening rod 4 which rest on opposing sides of the substrate and carrier material 1, resp., to be moistened—FIG. 2 shows this arrangement. Based on a moistening via direct contact with both moistening rods 3 and 4 it is possible for the first time to moisten the substrate 1 from both sides homogeneously with a lotion and dispersion, resp. The section across the moistened substrate in FIG. 3 shows the resulting desired homogeneous distribution of the washing active substances and solid components 2, resp., of the dispersion. Depending on the field of application, the dispersion to be applied can, for example, contain the ingredients shown in Tab. 1 above. As mentioned above, the use of the brightener/builder—which can contain zeolites—is only possible in connection with the three-phase laundry detergent wipe but not with mere liquid washing detergents. The same applies to the phyllosilicates which can be used as an additive.

The invention claimed is:

1. A method for manufacturing a three-phase heavy-duty laundry detergent wipe for cleaning textiles, the method consisting of:

applying a dispersion comprising a liquid washing detergent (5) as a first phase and a water insoluble functional additive (2) as a second phase to a substrate (1) which is solid at ambient temperature as a third phase, such that said three-phase heavy-duty laundry detergent wipe comprises one liquid and two solid phases.

2. The method of claim 1, wherein said second phase (2) of the dispersion comprises a zeolite.

3. The method of claim 1, wherein said first phase (5) of the dispersion has a viscosity greater than 500 mPas.

4. The method of claim 1, wherein said dispersion (5, 2) is statistically fixed to the substrate (1).

5. The method of claim 1, wherein said substrate comprises viscose, polyethylene, polypropylene, or polyester.

6. A method for manufacturing a homogeneous three-phase laundry detergent wipe for cleaning textiles, the method consisting of:

applying a dispersion to a substrate (1) which is solid at ambient temperature, and wherein said substrate is moistened with said dispersion via direct contact with a first moistening rod (3) which rests on one side of the substrate to be moistened and a second counter moistening rod (4) which rests on the opposing side of the substrate to be moistened such that the three-phase heavy-duty laundry detergent wipe comprises one liquid and two solid phases and the washing active substances and solid components of the dispersion (2) are distributed homogeneously across the substrate after moistening.

7. The method for manufacturing a homogeneous three-phase laundry detergent wipe of claim 6, wherein the dispersion comprises zeolites and/or phyllosilicates as a second solid phase (2) in addition to a liquid washing detergent as a first liquid phase.

8. The method for manufacturing a homogeneous three-phase laundry detergent wipe of claim 6, wherein the first liquid phase of the dispersion has a viscosity greater than 500 mPas.

9. The method for manufacturing a homogeneous three-phase laundry detergent wipe of claim 6, wherein the substrate (1) comprises viscose, polyethylene, polypropylene, or polyester.

10. The method for manufacturing a homogeneous three-phase laundry detergent wipe of claim 6, wherein said dispersion comprises any further known component of a heavy-duty laundry detergent in the first phase.

* * * * *